US010448748B2

(12) United States Patent
Neuenswander et al.

(10) Patent No.: US 10,448,748 B2
(45) Date of Patent: Oct. 22, 2019

(54) FOLDING MATTRESS-RETENTION MECHANISM

(71) Applicant: L&P PROPERTY MANAGEMENT COMPANY, South Gate, CA (US)

(72) Inventors: Jacob J. Neuenswander, Carthage, MO (US); David Joseph Aguirre, Springfield, MO (US)

(73) Assignee: L&P Property Management Company, South Gate, CA (US)

( * ) Notice: Subject to any disclaimer, the term of this patent is extended or adjusted under 35 U.S.C. 154(b) by 30 days.

(21) Appl. No.: 15/297,395

(22) Filed: Oct. 19, 2016

(65) Prior Publication Data

US 2018/0103771 A1 Apr. 19, 2018

(51) Int. Cl.
*A47C 21/02* (2006.01)

(52) U.S. Cl.
CPC ..... *A47C 21/026* (2013.01)

(58) Field of Classification Search
CPC ..... A47C 21/026; A47C 21/025
USPC ..... 5/193, 658, 659
See application file for complete search history.

(56) References Cited

U.S. PATENT DOCUMENTS

| | | | | |
|---|---|---|---|---|
| 1,240,201 | A * | 9/1917 | Haskes | A47C 21/026 224/42.34 |
| 1,371,098 | A * | 3/1921 | Jones | A47C 21/026 5/193 |
| 8,776,294 | B1 * | 7/2014 | McCarty | A47C 21/026 5/193 |
| 2009/0217485 | A1 * | 9/2009 | Springer | E05D 7/009 16/297 |

* cited by examiner

*Primary Examiner* — Fredrick C Conley
(74) *Attorney, Agent, or Firm* — Shook, Hardy & Bacon, L.L.P.

(57) ABSTRACT

A mechanism for securing a mattress on a bed foundation is provided. More particularly, the invention relates to a folding mattress-retention mechanism that may compactly fold or be easily removed during shipping or storage. The folding mattress-retention mechanism includes a mattress-support structure, a first hinged attachment, and a second hinged attachment. The mattress-support structure includes a first and second end and may abut a side of a mattress atop a bed foundation. The first and second hinged attachments are coupled to the mattress-support structure at the respective first and second ends and may either affix or removably attach the folding mattress-retention mechanism to the foot, head, or sides of a bed foundation. Further, the hinged attachments may allow for movement, and the folding mattress-retention mechanism may move into and between an operable first position and a stowed second position.

20 Claims, 7 Drawing Sheets

FOLDING MATTRESS-RETENTION MECHANISM

CROSS-REFERENCE TO RELATED APPLICATIONS

Not applicable.

STATEMENT REGARDING FEDERALLY SPONSORED RESEARCH OR DEVELOPMENT

Not applicable.

TECHNICAL FIELD

The present invention generally relates to a mechanism for securing a mattress on a conventional or an automated bed. More particularly, the invention relates to a folding mattress-retention mechanism for preventing a mattress from moving about a bed foundation that is capable of compactly folding or being easily removed during shipping and storage.

BACKGROUND OF THE INVENTION

A variety of methods are used to prevent a mattress from shifting past the edge of a bed foundation. Traditional mattress-retention methods include foot retainer bars, snaps, zippers, buckles, bars, Velcro®, clips, pockets, and non-slip fabrics or surfaces. Many of these methods help prevent a mattress from moving with respect to the base of a bed during normal use in conventional beds and also automated, articulating beds. However, these retention methods require modifications to the bed foundation, which may include the implementation of static, vertically protruding retention structures. These retention structures hinder compaction of the bed foundation causing shipping and storage to be difficult and disadvantageous.

Accordingly, a need exists for a reliable folding mattress-retention mechanism that is capable of being easily moved between an operational position and a storage position to allow for compaction of a conventional or automated bed foundation during shipping or storage, which addresses the foregoing and other problems.

BRIEF SUMMARY OF THE INVENTION

The present invention generally relates to a folding mattress-retention mechanism that prevents a mattress from moving about a bed foundation and is capable of compactly folding into a stowed, shipping or storage position. In one embodiment, a folding mattress-retention mechanism includes a mattress-support structure that is coupled to a first and a second hinged attachment that are configured to secure the folding mattress-retention mechanism to the foot, head, or sides of a bed foundation. The mattress-support structure is arcuate and has a first and a second end, with the first end being proximate to the first hinged attachment and the second end being proximate to the second hinged attachment. Moreover, the first and second hinged attachments are capable of allowing movement of the mattress-support structure such that the folding mattress-retention mechanism may be positioned in and moved between an operable first position and a stowed second position. In the operable first position, the mattress-support structure extends vertically, is substantially perpendicular to a top surface of the bed foundation, and abuts a mattress atop the bed foundation. In the second position, the mattress-support structure extends horizontally, is substantially parallel to the top surface, and lies adjacent to the bed foundation. Further, the first and second hinged attachments may be configured to be affixed or removably attached to the top surface or a bottom surface of the bed foundation.

In another embodiment, the mattress-support structure is coupled to a first and a second fixed attachment proximate to the first and second ends, respectively. The first and second fixed attachments are configured to removably attach the folding mattress-retention mechanism to the bed foundation such that the folding mattress-retention mechanism may easily be attached to the bed foundation during use and easily removed during shipping or storage. The mattress-support structure and the first and second fixed attachments are statically joined such that the mattress-support structure is fixed in the operable first position while the folding mattress-retention mechanism is removably attached to the bed foundation.

Additional objects, advantages, and novel features of the invention will be set forth in part in the description which follows, and in part will become apparent to those skilled in the art upon examination of the following, or may be learned by practice of the invention.

BRIEF DESCRIPTION OF SEVERAL VIEWS OF THE DRAWING

The present invention is described in detail below with reference to the attached drawing figures, wherein.

DETAILED DESCRIPTION OF THE INVENTION

Figure 1:
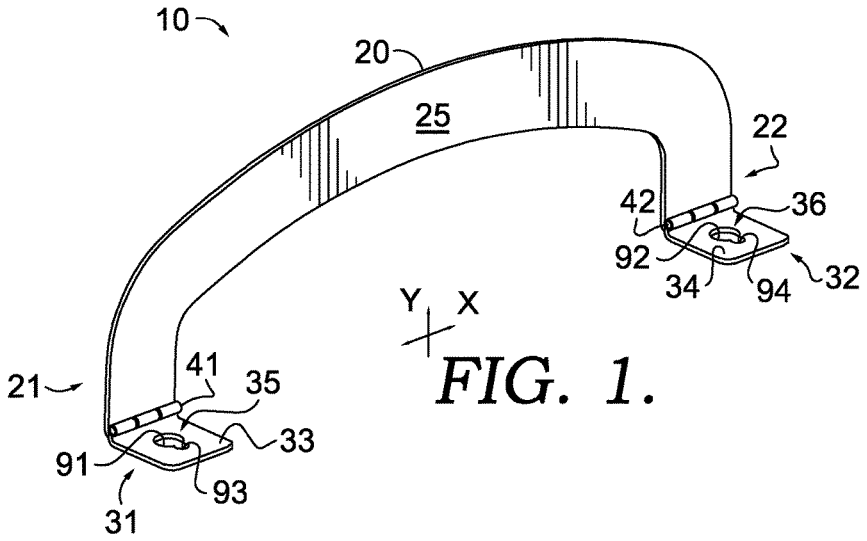
FIG. 1 is a front perspective view of a folding mattress-retention mechanism.

An embodiment of a folding mattress-retention mechanism 10 is seen in FIGS. 1-4. Referring first to FIG. 1, a front perspective view of the folding mattress-retention mechanism 10 includes a mattress-support structure 20 with a first end 21 and a second end 22. The mattress-support structure 20 extends between the first and second ends 21, 22 and forms an arcuate shape, initially extending vertically at the first and second ends 21, 22 and then extending horizontally away from the first and second ends 21, 22 towards the center. In addition, the mattress-support structure 20 is substantially planar presenting an interior surface 25 that is flat and adjacent to a mattress or a bed foundation during use. In other embodiments, the mattress-support structure 20 may be other shapes, including, without limitation, round, hexagonal, square, triangular, octagonal, or tubular. In addition, the folding mattress-retention mechanism 10 includes a first hinged attachment 31 and a second hinged attachment 32, both of which may be rectangular in shape and substantially planar, thereby presenting a first attachment surface 33 and a second attachment surface 34, respectively. In other embodiments, the first and second hinged attachments 31, 32 may be other shapes, including, without limitation, hexagonal, square, triangular, or octagonal. Further, the mattress-support structure 20 and the first and second hinged attachments 31, 32 may be constructed from metal, plastic, or any other material that will retain a mattress while maintaining shape and may be molded, cast, or machined.

Continuing with FIG. 1, the first and second hinged attachments 31, 32 include a first coupling mechanism 41 and a second coupling mechanism 42. As shown, the first coupling mechanism 41 couples the first hinged attachment 31 with the mattress-support structure 20 proximate to the first end 21, and the second coupling mechanism 42 couples the second hinged attachment 32 with the mattress-support structure 20 proximate to the second end 22. In a further aspect, the first and second hinged attachments 31, 32 are configured by the first and second coupling mechanisms 41, 42 to allow the mattress-support structure 20 to move in a hinged manner as further explained below.

Figure 2:
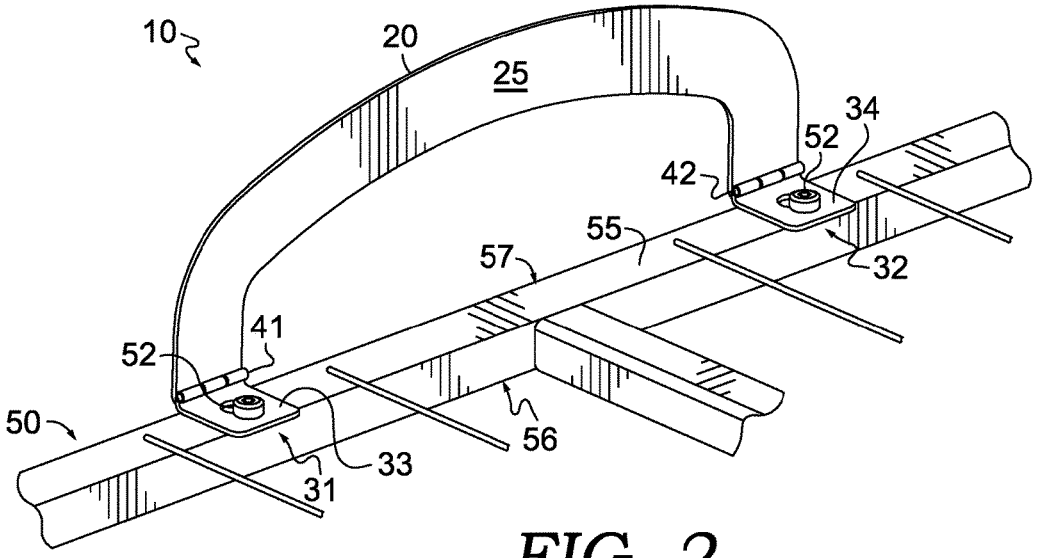
FIG. 2 is a front perspective view of the folding mattress-retention mechanism of FIG. 1 affixed to a bed foundation.

With reference now to FIG. 2, the folding mattress-retention mechanism 10 of FIG. 1 is shown affixed to a bed foundation 50 through the first and second hinged attachments 31, 32. The bed foundation 50 may be of conventional design having a rectangular, cage-like structure with a foot, a head and two sides that present a top surface 55, a bottom surface 56, and an exterior surface 57. The first and second attachment surfaces 33, 34 may be used to affix the folding mattress-retention mechanism 10 to a top surface 55 of the bed foundation 50 using corresponding first and second attachment mechanisms 51, 52. Although the first and second attachment mechanisms 51, 52 in FIG. 2 are depicted as a slide and lock screw, a variety of types of first and second attachment mechanisms 51, 52 may be used to affix the folding mattress-retention mechanism 10 to the bed foundation 50, including posts, pegs, bolts, hooks, or other devices. Moreover, the first and second attachment mechanisms 51, 52 may be configured to affix the folding mattress-retention mechanism 10 to the bed foundation 50 as shown in FIG. 2, or may be configured to removably attach the folding mattress-retention mechanism 10 to the bed foundation 50.

Figure 10:
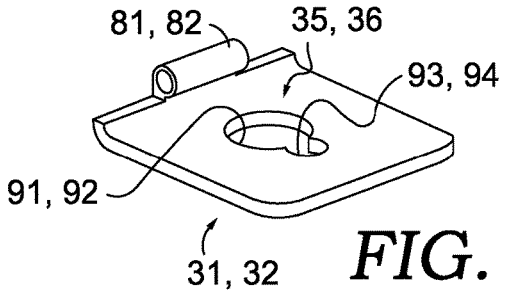
FIG. 10 is a front perspective view of a hinged attachment.

In addition, the first and second hinged attachments 31, 32 may be configured to include various features depending on the type of first and second attachment mechanisms 51, 52. For instance, as shown in FIGS. 1 and 10, the first and second hinged attachments 31, 32 may respectively include a first opening 35 and a second opening 36 that may be positioned centrally on the first and second attachment surfaces 33, 34 and may be configured for receiving and removably engaging the first and second attachment mechanisms 51, 52. The first opening 35 may include a first relief hole 91 and a first slot 93 and the second opening 36 may include a second relief hole 92 and a second slot 94. Generally, the first and second openings 35, 36 may be oblong circular in shape such that the first and second slots 93, 94 have a first diameter and the first and second relief holes 91, 92 have a second diameter that is larger than the first diameter. Further, the second diameter of the first and second relief holes 91, 92 is wide enough to pass a head of a screw (or a head of other types of first and second attachment mechanisms 51, 52) therethrough, while the first diameter of the first and second slots 93, 94 is not. Accordingly, the first and second attachment mechanisms 51, 52 may removably attach the folding mattress-retention mechanism 10 to the bed foundation 50 by extending through the first and second openings 35, 36 to engage the bed foundation 50. More specifically, the folding mattress-retention mechanism 10 may be easily positioned such that the first and second attachment mechanisms 51, 52 are aligned with the first and second relief holes 91, 92 or the first and second slots 93, 94. The folding mattress-retention mechanism 10 may be removed from the bed foundation 50 when the first and second attachment mechanism 51, 52 are aligned with the first and second relief holes 91, 92 and may be secured to the bed foundation 50 when the first and second attachment mechanisms 51, 52 are aligned with the first and second slots 93, 94.

In a further aspect, the first and second hinged attachments 31, 32 are configured to affix the folding mattress-retention mechanism 10 to the foot, head or sides of the bed foundation 50 at multiple locations. As depicted in FIG. 2, the first and second attachment surfaces 33, 34 are configured to complement the structure of the bed foundation 50 presented by the top surface 55. Accordingly, the first and second attachment surfaces 33, 34 are flat like the top surface 55 in order to allow for a more convenient and stronger affixing of the folding mattress-retention mechanism 10 to the bed foundation 50. In other embodiments, the first and second hinged attachments 31, 32 may be configured to affix the folding mattress-retention mechanism 10 to a bed foundation of differing design with different structure and size than the bed foundation 50 as depicted in FIG. 2. In such embodiments, the first and second attachment surfaces 33, 34 may be configured to complement a surface presented at the foot, head, and sides of a given bed foundation, and therefore, the first and second attachment surfaces 33, 34 may be larger, smaller, curved, angled, or non-rectangular.

Figure 3:
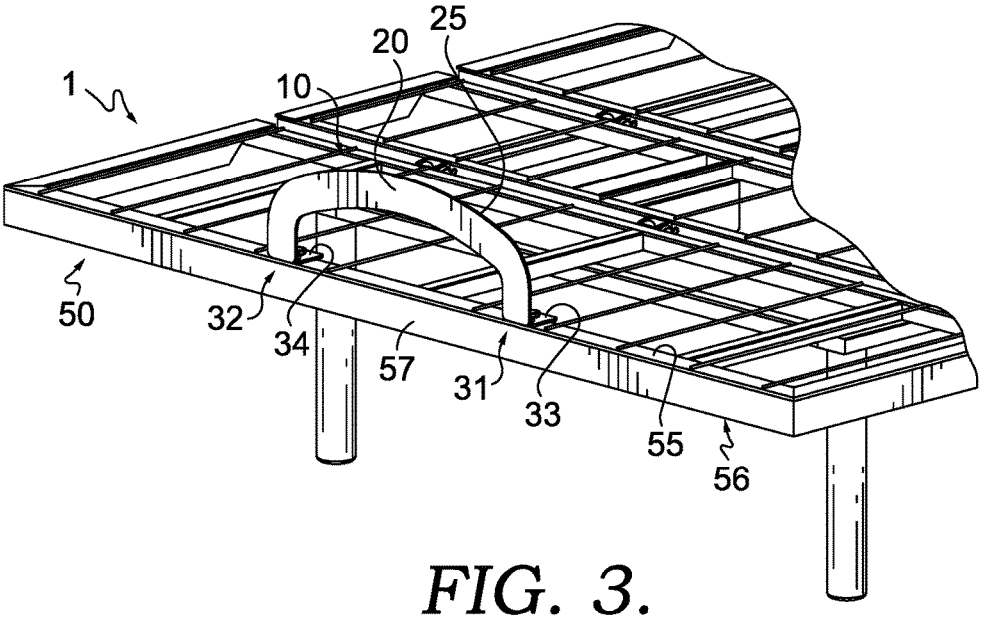
FIG. 3 is a rear perspective view of the folding mattress-retention mechanism of FIG. 1 in a first position.
Figure 4:
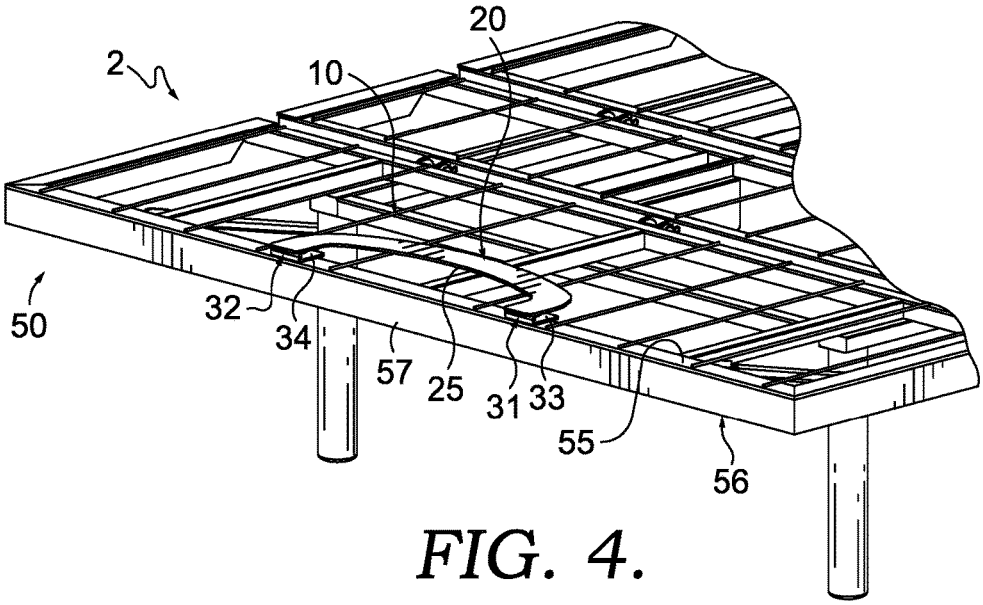
FIG. 4 is rear perspective view of the folding mattress-retention mechanism of FIG. 1 in a second position.

Turning now to FIGS. 3 and 4 and with reference to FIG. 2, the folding mattress-retention mechanism 10 of FIG. 1 is shown in an operable first position 1 in FIG. 3 and is shown in a stowed second position 2 in FIG. 4. In both the operable first position 1 and the stowed second position 2, the folding mattress-retention mechanism 10 is affixed to the bed foundation 50 through the first and second hinged attachments 31, 32. More specifically, the first and second attachment surfaces 33, 34 are affixed to the top surface 55 by the first and second attachment mechanisms 51, 52 such that the first and second attachment surfaces 33, 34 are superposed and parallel to the top surface 55.

In the operable first position 1 as shown in FIG. 3, the mattress-support structure 20 is coupled to first and second hinged attachments 31, 32 by the first and second coupling mechanisms 41, 42 such that the mattress-support structure 20 extends vertically upward away from the bed foundation 50 and is positioned substantially perpendicular to the first and second hinged attachments 31, 32 as well as first and second attachment surfaces 33, 34. Thus, the mattress-support structure 20 is also perpendicular to the top surface 55 and in alignment with the exterior surface 57. As such, the mattress-support structure 20 is in substantial vertical alignment with the bed foundation 50 at the exterior surface 57 causing the interior surface 25 to abut a mattress placed atop the bed foundation 50.

With reference to FIG. 4, in the stowed second position 2, the mattress-support structure 20 is coupled to the first and second hinged attachments 31, 32 by the first and second coupling mechanisms 41, 42 such that the mattress-support structure 20 extends horizontally above the bed foundation 50 and is positioned substantially parallel to the first and second hinged attachments 31, 32 as well as first and second attachment surfaces 33, 34. Further, the mattress-support structure 20 is positioned parallel to the top surface 55 and perpendicular to the exterior surface 57. Therefore, the mattress-support structure 20 is in substantial horizontal alignment with the bed foundation 50 at the top surface 55 causing the interior surface 25 to be superposed to the top surface 55 of the bed foundation 50.

Figure 5:
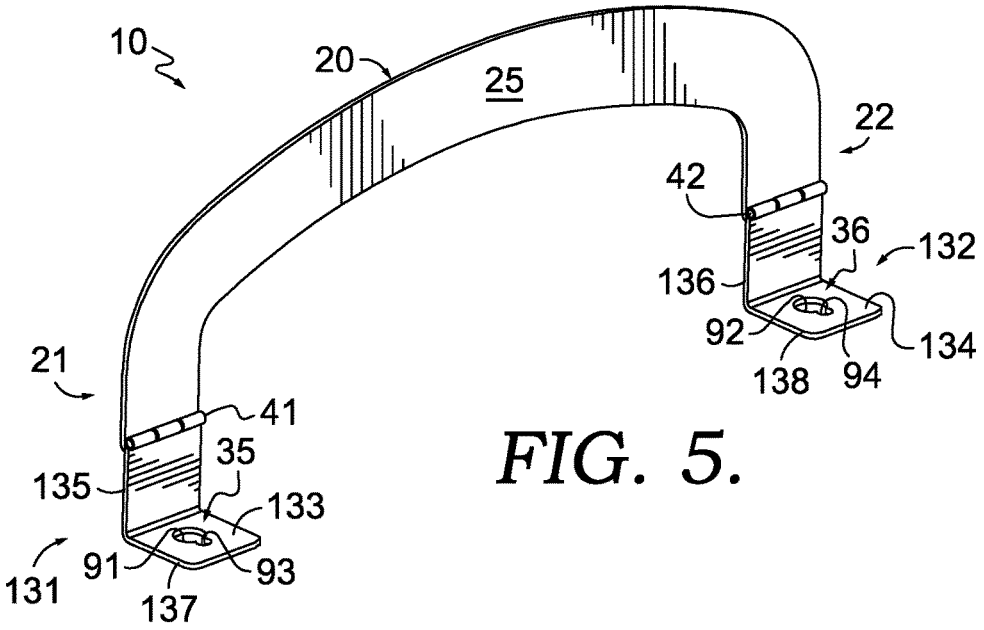
FIG. 5 is a front perspective view of a folding mattress-retention mechanism.

Referring to FIGS. 5-8, an alternative embodiment of the folding-mattress retention mechanism 10 is shown that comprises the same components as previously disclosed but includes a first bottom hinged attachment 131 and a second bottom hinged attachment 132 rather than the first and second hinged attachments 31, 32. With reference to FIG. 5, the first bottom hinged attachment 131 comprises a first vertical extension member 135 and a first horizontal attachment member 137, and the second bottom hinged attachment 132 comprises a second vertical extension member 136 and a second horizontal attachment member 138. The first and second vertical extension members 135, 136 and the first and second horizontal attachment members 137, 138 are respectively joined in a perpendicular manner such that an L-shape is formed. Both, the first and second vertical extension members 135, 136 and the first and second horizontal attachment members 137, 138 are substantially planar and rectangular in shape. The first and second vertical extension members 135, 136 each present a respective surface, a first bottom attachment surface 133 and a second bottom attachment surface 134. Further, the first and second vertical extension members 135, 136 and the first and second horizontal attachment members 137, 138 may be constructed from metal, plastic, or any other durable material and may be molded, cast, or machined individually or together.

Staying with FIG. 5, the first and second bottom hinged attachment 131, 132 are coupled to the mattress-support structure 20 at the first and second vertical extension members 135, 136. Thus, at the first end 21, the first coupling mechanism 41 couples the first bottom hinged attachment 131 with the mattress-support structure 20 at the first vertical extension member 135, and at the second end 22, the second coupling mechanism 42 couples the second bottom hinged attachment 132 with the mattress-support structure 20 at the second vertical extension member 136.

Figure 6:
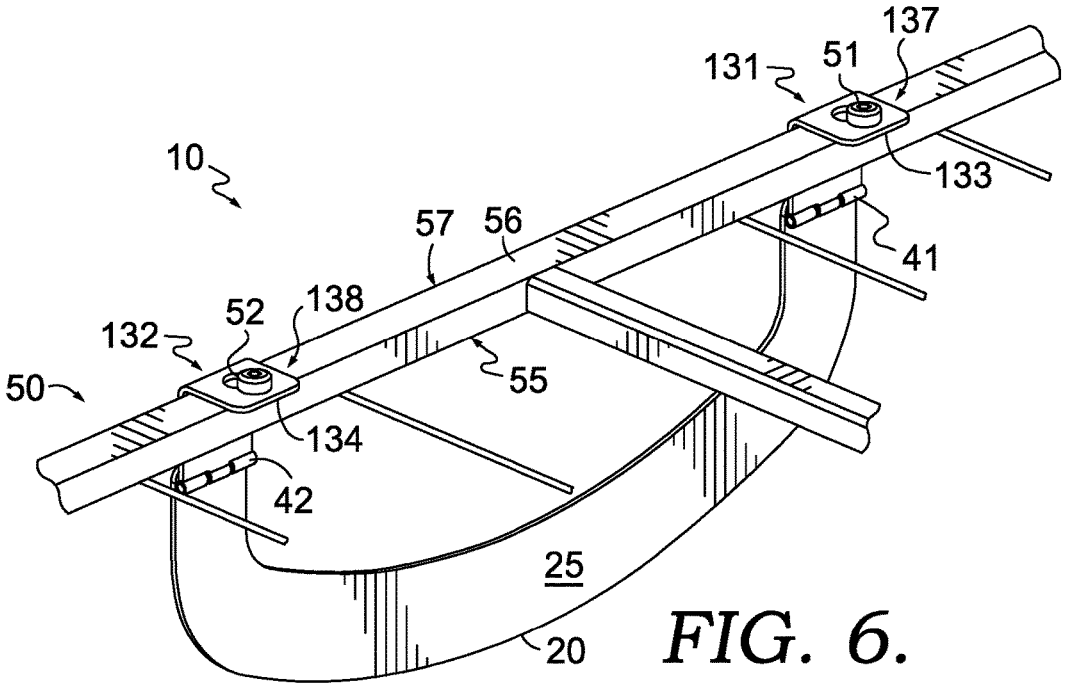
FIG. 6 is a front perspective view of the folding mattress-retention mechanism of FIG. 5 affixed to a bed foundation viewed from the underside of the bed foundation.

With reference now to FIG. 6, the folding mattress-retention mechanism 10 of FIG. 5 is shown affixed to the bed foundation 50 at the first and second bottom hinged attachments 131, 132. The first and second bottom attachment surfaces 133, 134 may be used to affix the folding mattress-retention mechanism 10 to the bottom surface 56 of the bed foundation 50 with the previously disclosed first and second attachment mechanisms 51, 52. Accordingly, when affixed to the bed foundation 50, the first and second horizontal attachment members 137, 138 are positioned adjacent to the bottom surface 56, and the first and second vertical extension members 135, 136 are positioned adjacent to the exterior surface 57. In addition, the first and second bottom hinged attachments 131, 132 may be configured in the same manner as the first and second hinged attachments 31, 32 to include various features depending on the type of first and second attachment mechanisms 51, 52. The first and second bottom hinged attachments 131, 132 may also include the first and second openings 35, 36 with first and second slots 93, 94 and first and second relief holes 91, 92 as described above.

Further, the first and second bottom hinged attachments 131, 132 are configured to affix the folding mattress-retention mechanism 10 to the foot, head or sides of the bed foundation 50 at multiple locations. As shown in FIG. 6, the first and second bottom attachment surfaces 133, 134, the first and second vertical extension members 135, 136, and the first and second horizontal attachment members 137, 138 are all configured to complement the structure of the bed foundation 50 presented along the exterior surface 57 and the bottom surface 56. Accordingly, the first and second bottom attachment surfaces 133, 134 are flat like the bottom surface 56, and the first and second vertical extension members 135, 136 and the first and second horizontal attachment members 137, 138 form an L-shape to complement the structure of the bed foundation 50 presented by the exterior surface 57 and bottom surface 56, both of which allow for a more convenient and stronger affixing of the folding mattress-retention mechanism 10 to the bed foundation 50. In other embodiments, the first and second bottom hinged attachments 131, 132 may be configured to affix the folding mattress-retention mechanism 10 to a bed foundation of differing design with different structure and size than the bed foundation 50 as depicted in FIG. 6. In such embodiments, the first and second bottom attachment surfaces 133, 134, the first and second vertical extension members 135, 136, and the first and second horizontal attachment members 137, 138 may all be configured to complement a surface or structure presented at the foot, head, and sides of a given bed foundation, and therefore, may be of different sizes and shapes.

Figure 7:
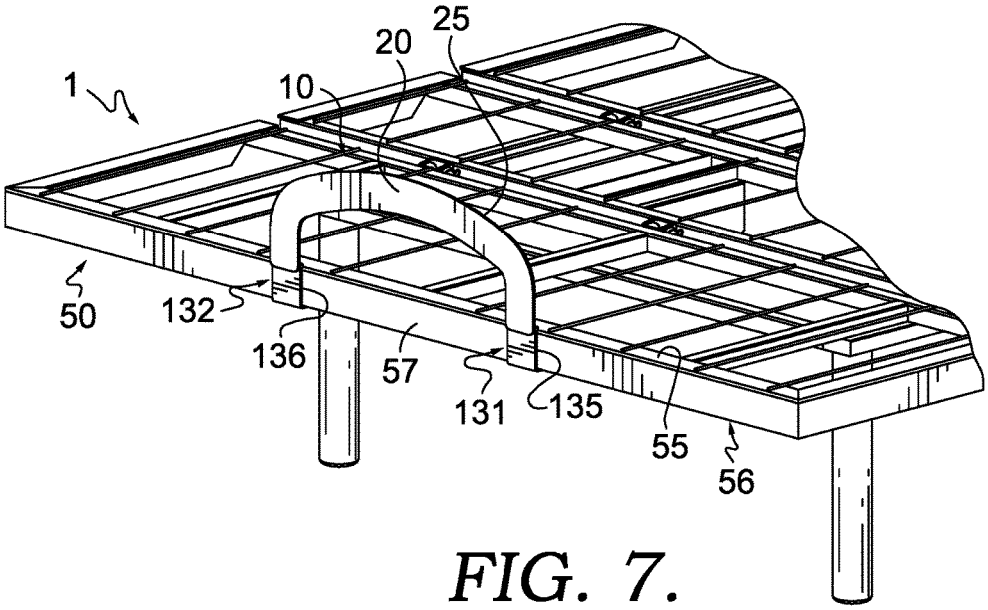
FIG. 7 is a rear perspective view of the folding mattress-retention mechanism of FIG. 5 in a first position.
Figure 8:
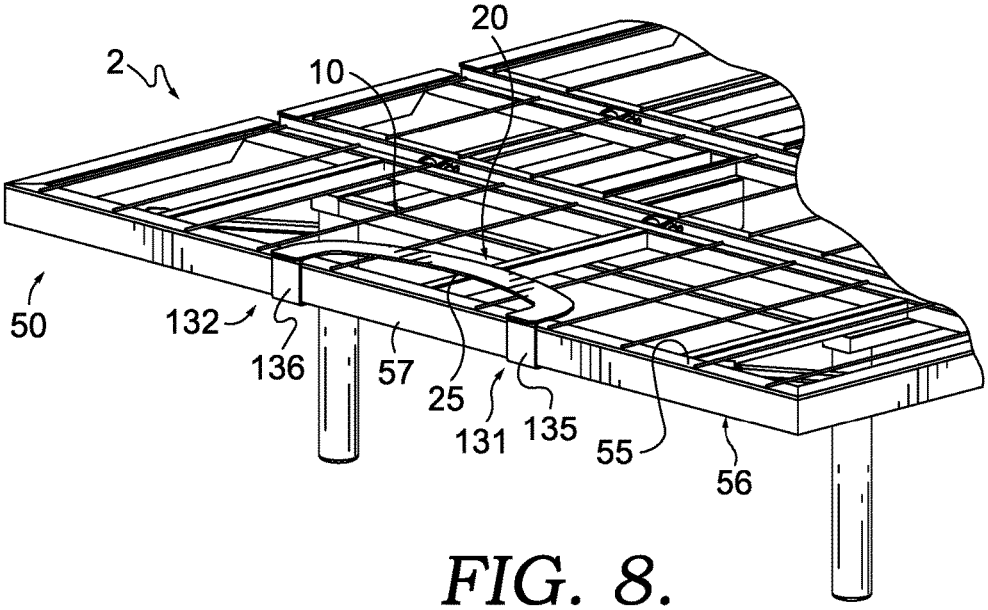
FIG. 8 is rear perspective view of the folding mattress-retention mechanism of FIG. 5 in a second position.

Now to FIGS. 7 and 8, the folding mattress-retention mechanism 10 of FIG. 5 is shown in the operable first position 1 in FIG. 7 and the stowed second position 2 in FIG. 8, both of which are generally consistent with the previous disclosure but for the first and second bottom hinged attachments 131, and 132. In both the operable first position 1 and the stowed second position 2, the folding mattress-retention mechanism 10 is affixed to the bed foundation 50 through the first and second bottom hinged attachments 131, 132. More pointedly, the first and second bottom attachment surfaces 133, 134 are affixed with the bottom surface 56 through the first and second attachment mechanisms 51, 52 such that the first and second bottom attachment surfaces 133, 134 are adjacently below and parallel to the bottom surface 56.

In the operable first position 1 as shown in FIG. 7, the mattress-support structure 20 is coupled to the first and second bottom hinged attachments 131, 132 by the first and second coupling mechanisms 41, 42 such that the mattress-support structure 20 extends vertically upward away from the bed foundation 50 and is aligned with the first and second vertical extension members 135, 136 and perpendicular to both the first and second horizontal attachment members 137, 138 and the first and second bottom attachment surfaces 133, 134. Thus, the mattress-support structure 20 is positioned perpendicular to the top and bottom surfaces 55, 56 and is also aligned with the exterior surface 57. Accordingly, the mattress-support structure 20 is in substantial vertical alignment with the bed foundation 50 at the exterior surface 57 causing the interior surface 25 to abut a mattress placed atop the bed foundation 50.

In the stowed second position 2 depicted in FIG. 8, the mattress-support structure 20 is coupled to first and second bottom hinged attachments 131, 132 by the first and second coupling mechanisms 41, 42 such that the mattress-support structure 20 extends horizontally above the bed foundation 50 and is positioned substantially parallel to both the first and second horizontal attachment members 137, 138 and the first and second bottom attachment surfaces 133, 134 and is positioned perpendicular to the first and second vertical extension members 135, 136. Further, the mattress-support structure 20 is positioned parallel to the top and bottom surfaces 55, 56 and perpendicular to the exterior surface 57. Therefore, the mattress-support structure 20 is in substantial horizontal alignment with the bed foundation 50 at the top surface 55 causing the interior surface 25 to be superposed to the top surface 55 of the bed foundation 50.

Figure 9:
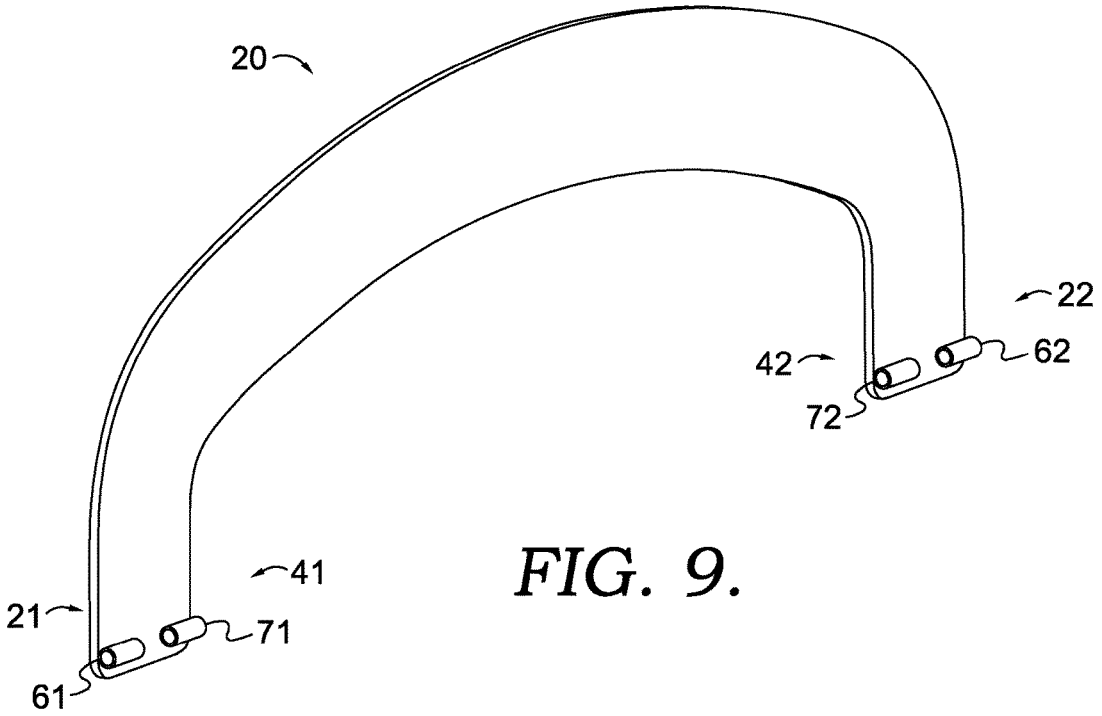
FIG. 9 is a front perspective view of a mattress-support structure.
Figure 11:
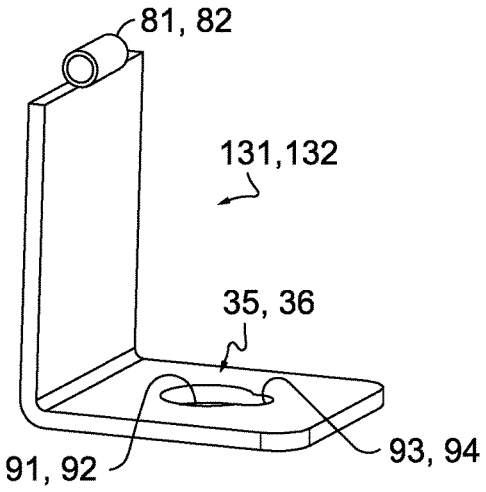
FIG. 11 is a front perspective view of a bottom hinged attachment.

In a further aspect of the folding mattress-retention mechanism 10 of FIGS. 1-8, the first and second hinged attachments 31, 32 are configured to pivot the mattress-support structure 20 between the operable first position 1 and the stowed second position 2. The first and second coupling mechanisms 41, 42 are configured to form joints between the mattress-support structure 20 and either the first and second hinged attachments 31, 32 or the first and second bottom hinged attachments 131, 132 that allow for hinged movement. In some embodiments, the first and second coupling mechanisms 41, 42 may comprise hollow cylinder segments attached to either the first and second hinged attachments 31, 32 or the mattress-support structure 20 at the first and second ends 21, 22. For example, as shown in FIG. 9, a first outer cylinder segment 61 and a first inner cylinder segment 71 may be attached to the mattress-support structure 20 at the first end 21, and a second outer cylinder segment 62 and a second inner cylinder segment 72 may be attached to the mattress-support structure 20 at the second end 22. Further, a first center cylinder segment 81 and a second center cylinder segment 82 may be attached to the respective first and second hinged attachments 31, 32 or the respective first and second bottom hinged attachments 131, 132, which can be seen in FIGS. 10 and 11. Thus, the first cylinder segments 61, 71, 81 and the second cylinder segments 62, 72, 82 may be respectively aligned to form continuous chambers. An internal member (not shown) may be positioned through each continuous chamber, thereby fixing the first cylinder segments 61, 71, 81 and the second cylinder segments 62, 72, 82 in alignment and coupling the mattress-support structure 20 to either the first and second hinged attachments 31, 32 or the first and second bottom hinged attachments 131, 132. The hollow cylinder segments may be attached to the mattress-support structure 20, the first and second hinged attachments 31, 32 or the first and second bottom hinged attachments 131, 132 through welding or using other methods known in the art.

Further, the first and second coupling mechanisms 41, 42 are configured such that the mattress-support structure 20 may only move into and between the operable first position 1 and the stowed second position 2. The first and second coupling mechanisms 41, 42 are further configured such that the mattress-support structure 20 may be locked in the operable first position 1 or the stowed second position 2. The foregoing may be affected using known lockable hinged or pivoted coupling mechanisms such as a hinge that is capable of being locked in either a retracted or an extended position.

Figure 12:
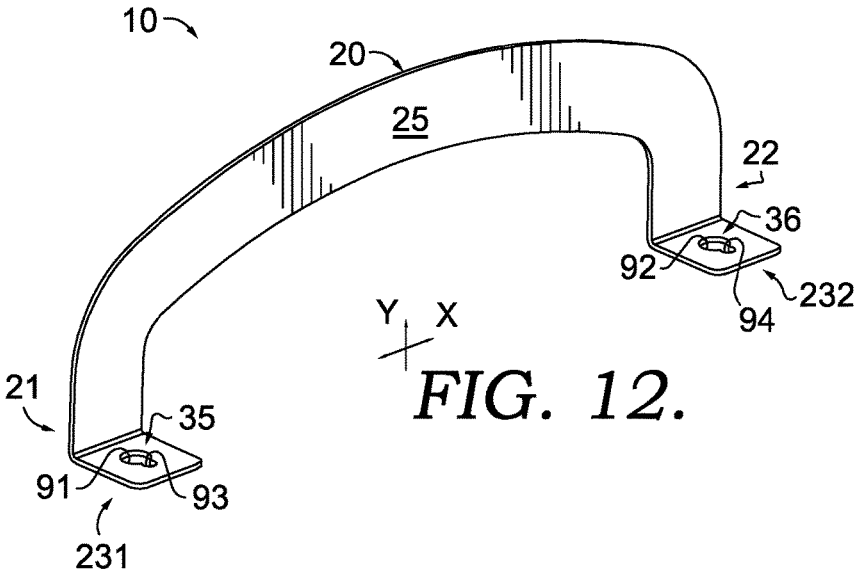
FIG. 12 is a front perspective view of a folding mattress-retention mechanism.
Figure 13:
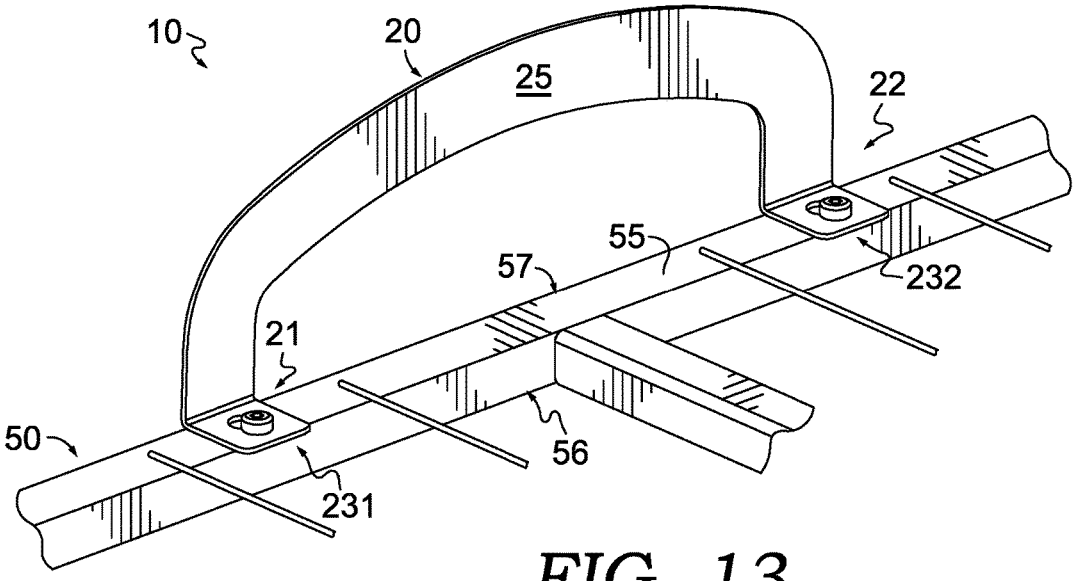
FIG. 13 is a front perspective view of the folding mattress-retention mechanism of FIG. 12 affixed to a bed foundation.

In an additional embodiment shown in FIGS. 12 and 13, the folding mattress-retention mechanism 10 may include a first fixed attachment 231 and a second fixed attachment 232 in place of the attachments previously disclosed. The first and second fixed attachments 231, 232 have the same components as the first and second hinged attachments 31, 32 but are not coupled to the mattress-support structure 20 by the first and second coupling mechanisms 41, 42. Instead, the first and second fixed attachments 231, 232 join to the mattress-support structure 20 in a perpendicular manner such that the folding mattress-retention mechanism 10 is fixed in the operable first position 1 when attached to the bed foundation 50. Accordingly, the first and second fixed attachments 231, 232 and the mattress-support structure 20 may be welded together or attached in other ways that fix their positions through methods known in the art. The first and second fixed attachments 231, 232 and the mattress-support structure 20 may be constructed from metal, plastic, or any other material that will retain a mattress while maintaining shape and may be molded, cast, or machined. In embodiments, the first and second fixed attachments 231, 232 and the mattress-support structure 20 may be cast, molded, or machined together or individually. Thus, the folding mattress-retention mechanism 10 may be formed from a single part or at least two parts.

Moreover, the first and second fixed attachments 231, 232 are configured to removably attach the folding mattress-retention mechanism 10 to the bed foundation 50 through the first and second attachment mechanisms 51, 52 such that the folding mattress-retention mechanism 10 may be easily attached and removed from the bed foundation 50. The first and second attachment mechanisms 51, 52 may be any capable mechanism such as those previously described above. In addition, the first and second fixed attachments 231, 232 may be configured in the same manner as the first and second hinged attachments 31, 32 to include various features depending on the type of first and second attachment mechanisms 51, 52. The first and second fixed attachments 231, 232 may also include the first and second openings 35, 36 with first and second slots 93, 94 and first and second relief holes 91, 92 as described above.

Figure 14:
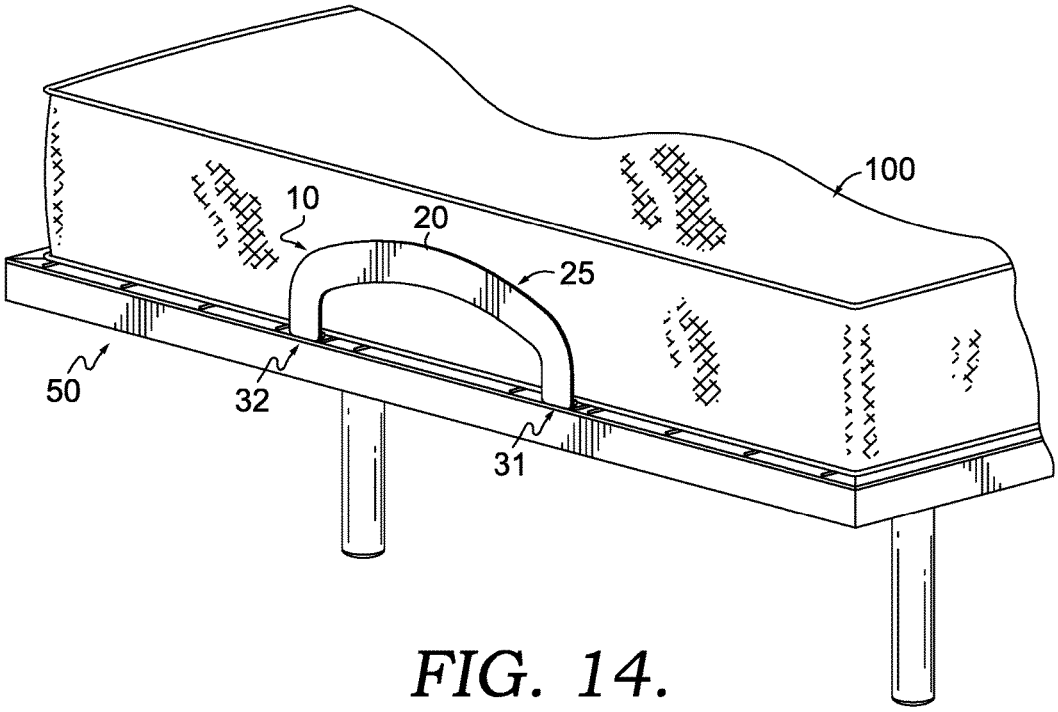
FIG. 14 is front perspective view of a folding mattress-retention mechanism affixed to a bed foundation with a mattress.

FIG. 14 shows the folding mattress-retention mechanism 10, in accordance with embodiments of the invention, with a mattress 100 positioned atop the bed foundation 50. The folding mattress-retention mechanism 10 is in the operable first position 1 and is affixed to the foot of the bed foundation 50 through the first and second hinged attachments 31, 32. As shown, the mattress-support structure 20 is positioned such that the interior surface 25 abuts the vertical side of the mattress 100, thereby preventing the mattress 100 from moving towards the foot end of the bed foundation 50. Although not shown, in other embodiments, the folding mattress-retention mechanism 10 may be affixed to the bed foundation 50 at different locations along the foot, head, or sides and through other attachments, such as the first and second bottom hinged attachments 131, 132 or the first and second fixed attachments 231, 232 and operate in the same manner as depicted in FIG. 14.

From the foregoing, it will be seen that this invention is one well adapted to attain all the ends and objects hereinabove set forth together with other advantages, which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

The invention claimed is:

1. A folding mattress-retention mechanism, comprising:

a mattress-support structure comprising a first end and a second end;

a first hinged attachment coupled to the mattress-support structure proximate to the first end and configured to affix to a bed foundation at a first surface; and a second hinged attachment coupled to the mattress-support structure proximate to the second end and configured to affix to the bed foundation at the first surface, wherein the first and second hinged attachments are configured to allow movement of the folding mattress-retention mechanism into and between a first position and a second position, wherein, when the first and second hinged attachments are affixed to the bed foundation and the folding mattress-retention mechanism is in the second position, the mattress-support structure extends horizontally, is parallel to the first surface, and lies adjacent to the bed foundation, and wherein the first surface is a top surface or a bottom surface of the bed foundation.

2. The folding mattress-retention mechanism of claim 1, wherein the mattress-support structure is substantially perpendicular to the first and second hinged attachments in the first position and wherein the mattress-support structure is substantially parallel to the first and second hinged attachments in the second position.

3. The folding mattress-retention mechanism of claim 2, wherein the first hinged and second hinged attachments are configured to removably lock the folding mattress-retention mechanism in the first position and the second position.

4. The folding mattress-retention mechanism of claim 2, wherein the first hinged attachment comprises a first attachment surface and a first opening and wherein the second hinged attachment comprises a second attachment surface and a second opening.

5. The folding mattress-retention mechanism of claim 4, wherein the folding mattress-retention mechanism further comprises a first attachment mechanism configured to partially extend through the first opening and engage the bed foundation and a second attachment mechanism configured to partially extend through the second opening and engage the bed foundation.

6. The folding mattress-retention mechanism of claim 2, wherein the folding mattress-retention mechanism further comprises a first coupling mechanism and a second coupling mechanism and wherein the first coupling mechanism is configured to couple the first hinged attachment to the mattress-support structure proximate to the first end and the second coupling mechanism is configured to couple the second hinged attachment to the mattress-support structure proximate to the second end.

7. The folding mattress-retention mechanism of claim 6, wherein the first and second coupling mechanisms each comprise more than one hollow cylinder segments.

8. The folding mattress-retention mechanism of claim 2, wherein the first hinged attachment comprises a first vertical extension member and a first horizontal attachment member that are affixed in a perpendicular position and wherein the second hinged attachment comprises a second vertical extension member and a second horizontal attachment member that are affixed in a perpendicular position.

9. The folding mattress-retention mechanism of claim 8, wherein the first horizontal attachment member comprises a first bottom attachment surface and a first opening and wherein the second horizontal attachment member comprises a second bottom attachment surface and a second opening.

10. The folding mattress-retention mechanism of claim 9, wherein the folding mattress-retention mechanism further comprises a first attachment mechanism configured to partially extend through the first opening and engage the bed foundation and a second attachment mechanism configured to partially extend through the second opening and engage the bed foundation.

11. The folding mattress-retention mechanism of claim 8, wherein the folding mattress-retention mechanism further comprises a first coupling mechanism and a second coupling mechanism and wherein the first coupling mechanism is configured to couple the first vertical extension member of the first hinged attachment to the mattress-support structure proximate to the first end and the second coupling mechanism is configured to couple the second vertical extension member of the second hinged attachment to the mattress-support structure proximate to the second end.

12. The folding mattress-retention mechanism of claim 11, wherein the first and second coupling mechanisms each comprise more than one hollow cylinder segment.

13. A folding mattress-retention mechanism, comprising:

a mattress-support structure comprising a first end, a second end, and an interior surface;

a first hinged attachment coupled to the mattress-support structure proximate to the first end, the first hinged attachment comprising a first attachment surface, a first opening, and a first coupling mechanism, wherein the first hinged attachment is planar and the first opening is positioned centrally on the first attachment surface;

a second hinged attachment coupled to the mattress-support structure proximate to the second end, the second hinged attachment comprising a second attachment surface, a second opening, and a second coupling mechanism, wherein the second hinged attachment is planar and the second opening is positioned centrally on the second attachment surface;

a first attachment mechanism configured to affix the first hinged attachment to a bed foundation at a top surface of the bed foundation; and a second attachment mechanism configured to affix the second hinged attachment to the bed foundation at the top surface.

14. The folding mattress-retention mechanism of claim 13, wherein the first attachment mechanism is configured to partially extend through the first opening and affix the first hinged attachment to the bed foundation proximate the first attachment surface, and wherein the second attachment mechanism is configured to partially extend through the second opening and affix the second hinged attachment to the bed foundation proximate the second attachment surface.

15. The folding mattress-retention mechanism of claim 13, wherein the first and second coupling mechanisms couple the first and second hinged attachments to the mattress-support structure and are configured to allow hinged movement between the first and second hinged attachments and the mattress-support structure.

16. The folding mattress-retention mechanism of claim 15, the folding mattress-retention mechanism is moveable into and between a first position and a second position and wherein the interior surface is substantially perpendicular to the first and second attachment surfaces in the first position and is substantially parallel to the first and second attachment surfaces in the second position.

17. A folding mattress-retention mechanism, comprising:

a mattress-support structure comprising a first end and a second end;

a first fixed attachment statically joined to the mattress-support structure proximate to the first end and configured to removably attach to a bed foundation at a top surface, the first fixed attachment comprising a first attachment surface configured to complement a structure of the top surface of the bed foundation; and a second fixed attachment statically joined to the mattress-support structure proximate to the second end and configured to removably attach to the bed foundation at the top surface, the second fixed attachment comprising a second attachment surface configured to complement the structure of the top surface of the bed foundation, wherein the mattress-support structure is substantially perpendicular to the first and second attachment surfaces.

18. The folding mattress-retention mechanism of claim 17, wherein the first attachment surface comprises a first opening, the first opening including a first relief hole and a first slot and wherein the second attachment surface comprises a second opening, the second opening including a second relief hole and a second slot.

19. The folding mattress-retention mechanism of claim 18, wherein the folding mattress-retention mechanism further comprises a first attachment mechanism configured to removably attach the folding mattress-retention mechanism to the bed foundation via the first opening and a second attachment mechanism configured to removably attach the folding mattress-retention mechanism to the bed foundation via the second opening.

20. The folding mattress-retention mechanism of claim 19, wherein the first and second relief holes are configured to allow the first and second attachment mechanisms to fully extend therethrough, and wherein the first and second slots are configured to allow the first and second attachment mechanisms to partially extend therethrough.

* * * * *